United States Patent [19]

Wivagg

[11] 4,083,311

[45] Apr. 11, 1978

[54] ARTICULATED SCHNABEL CAR

[75] Inventor: Adrian Peter Wivagg, Tolland, Conn.

[73] Assignee: Combustion Engineering, Inc., Windsor, Conn.

[21] Appl. No.: 726,880

[22] Filed: Sep. 27, 1976

[51] Int. Cl.[2] ..... B61D 5/04

[52] U.S. Cl. ..... 105/367

[58] Field of Search ..... 105/367

[56] References Cited

U.S. PATENT DOCUMENTS

| | | | |
|---|---|---|---|
| 3,608,501 | 9/1971 | Marxen et al. | 105/367 X |
| 3,834,322 | 9/1974 | Meier et al. | 105/367 |

*Primary Examiner*—Robert G. Sheridan

*Attorney, Agent, or Firm*—Wayne H. Lang

[57] ABSTRACT

A vehicle comprising separable wheeled sections that supports an elongated load therebetween in the manner of a Schnabel-type railway car or over-the-road vehicle. The vehicle is characterized by the inclusion of a pivotal arrangement intermediate coupled wheeled sections that reduces the longitudinal distance between vertical pivot points and, thus, reduces the side clearance required when empty cars are joined together and subjected to routine transportation over a curved roadway.

5 Claims, 4 Drawing Figures

ARTICULATED SCHNABEL CAR

BACKGROUND OF THE INVENTION

The present invention relates to an improved form of Schnable-type railway car that is adapted to transport long, rigid, loads intermediate separable fore and aft wheeled sections. After the load has arrived at its destination and has been removed from between fore and aft sections, the empty sections are joined together and returned to a central location where they are held in preparation for transporting another load.

Fore and aft wheeled sections of a Schnabel car have been limited to a length requiring not in excess of twelve supportive axles in order that coupled cars may readily negotiate curves in existing railway track. Current design in the nuclear, chemical, and other fields, however, calls for larger, longer and heavier equipment that requires upward to thirty-six axles for its support. This equipment is larger than may be readily carried over hills, through tunnels and around curves on any but selected sections of our existing railway track. However, such loads are readily adapted for shipping on barges or ships over waterways where there are no such size and weight limitations. It is obvious, however, that waterways do not always extend the entire distance between the manufacturing plant and the place of installation. Therefore, it has been proposed that "oversize" Schnabel-type apparatus be used to first transport a load to a barge or ship from its place of manufacture over carefully improved roadways. The load then would be placed on a ship and transported over the waterways to the closest port facilities adjacent its final destination, at which point the load would again be transferred to a waiting Schnabel car that had been transported in an empty condition between port facilities over existing track. The now greatly elongated Schnabel car assembly would then be moved over suitably modified track to its place of final installation.

Frequently bridges must be strenghtened, curves in the track straightened, and the road bed improved for those track sections over which a loaded Schnabel car is to be used. However, it is still necessary to transport an empty Schnabel car for long distances between the place of manufacture and the final destination. Inasmuch as linked Schnabel cars, even when empty, may be much too long to negotiate the curves on many sections of railway track, known apparatus is severely restricted in use to only those sections of railway track that have been completely rebuilt according to predetermined standards.

SUMMARY OF THE INVENTION

This invention is, therefore, directed to an arrangement by which empty Schnabel-type cars are pivotally linked together to effectively reduce the distance between pivot points thereof whereby linked cars may readily negotiate the curves on most existing sections of railway track.

BRIEF DESCRIPTION OF THE DRAWING

For a better understanding of my invention reference may be had to the attached drawing in which.

DESCRIPTION OF THE PREFERRED EMBODIMENT

Figure 1:
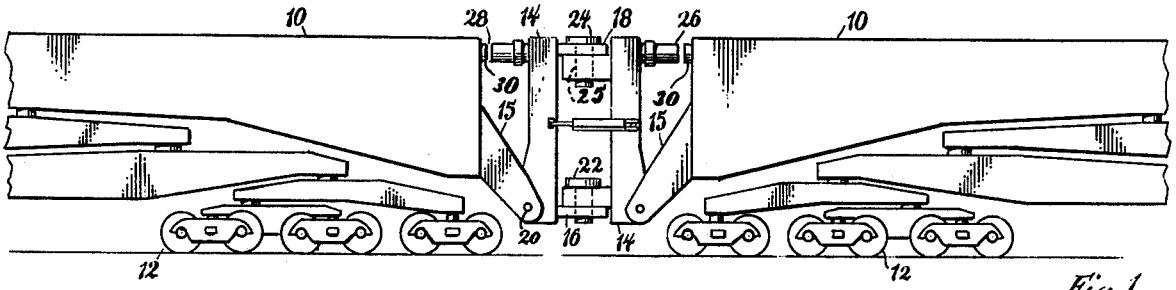
FIG. 1 is a side elevation of linked Schnable-type cars having an articulated linkage therebetween.
Figure 2:
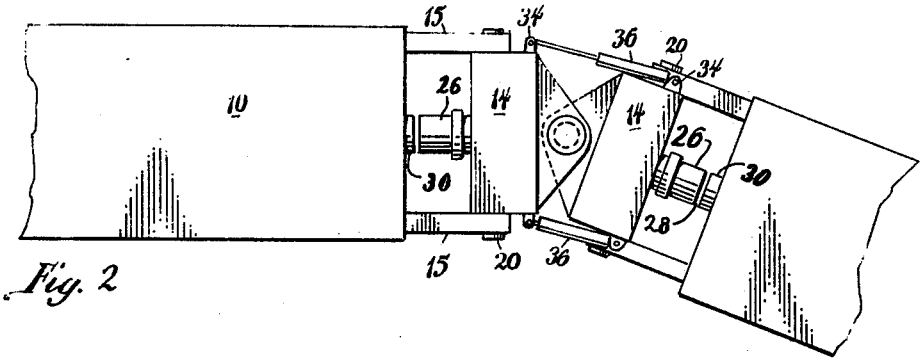
FIG. 2 is a partial top view of the arrangement shown in FIG. 1.

Referring more particularly to the drawing there is shown in FIG. 1 a side view of cooperating Schnabel cars 10 on wheeled sections 12 coupled together for transportation in an empty condition by means of an articulated fixture constructed according to the present invention.

The articulated fixture comprises a central box-type connecting arm 14 that extends vertically between pivotal tension fitting 16 at the bottom of arm 14 and compression fitting 18 at the upper end of the connecting arm 14. The tension fittings 16 and the compression fittings 18 of adjacent fixtures extend horizontally in a confronting relation and are offset vertically one from the other to permit pivot pins 22 and 24 to be placed through vertical apertures 25 therein whereby the several sections may be pivotally linked together about a single vertical axis.

Pivotal linkages 34 at the sides of each connecting arm 14 are provided to permit the attachment thereto of damping means 36 to opposite sides thereof to eliminate erratic movement and vibration of adjacent articulated arms when they are coupled together and being transported in an unloaded condition.

Each connecting arm 14 is attached by means of a removable pivot pin 20 to paired tension arms 15 that are integral with the respective Schnabel car such that the entire arm 14 may be pivoted about a horizontal axis. At the upper end of each connecting arm 14 is a compression member 26 having a plane outer surface 28 that is adapted to abut compression pad 30 on the Schnabel car in the usual manner when it is in a "loaded" condition.

When the Schnabel cars are in a loaded condition, the tension arms 15 are attached directly to the intervening load so the pivotal connecting arms 14 are deemed unnecessary, and must be removed and transported independently. Accordingly, each arm 14 is adapted to be removed by the removal of horizontal pivot pin 20 whereby both connecting arms 14 may be placed on a separate flatcar or the like and transported independent from the Schnabel car.

Inasmuch as pivotal connections having both a vertical and a horizontal axis of movement are located intermediate wheeled sections of the Schnabel car, the distance between pivotal sections is substantially reduced and a series of cars having articulated Schnabel cars therein are adapted to negotiate most curves and grades of existing track systems. Only that section of the track over which a greatly elongated Schnabel car assembly in a loaded condition is scheduled to travel need be straightened or otherwise improved.

Figure 3:
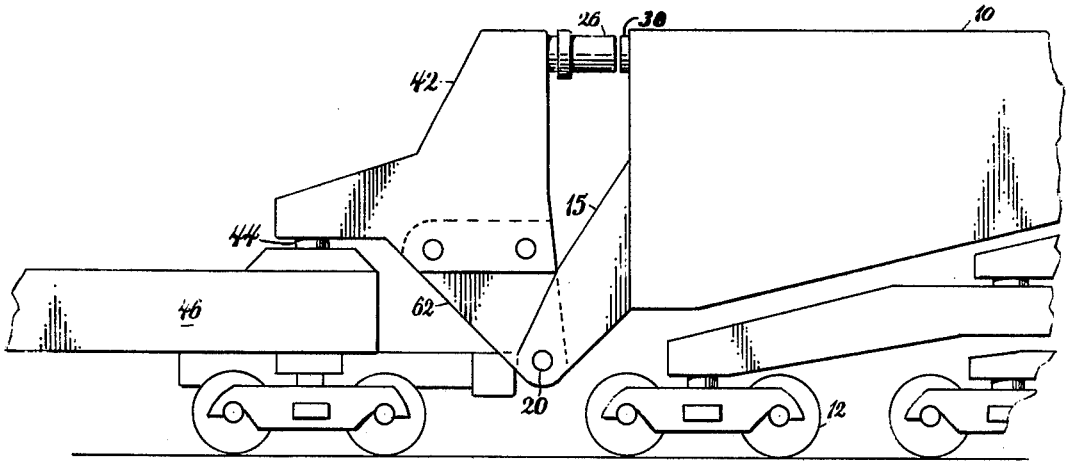
FIG. 3 is a side elevation of a modified form of articu-Schnabel car.

A modified form of the invention is shown in FIG. 3 where an unloaded Schnabel car having a "mini-arm" 42 is supported at one end by vertical pivots 44 carried on the opposite ends of an open well flatcar 46. A horizontal pivot pin 20 connects mini-cam 42 to the tension arm 15 while a compression member 26 having a plane outer edge 28 is adapted to abut pad 30 on the car 10 in the manner of the device shown in FIG. 1.

Figure 4:
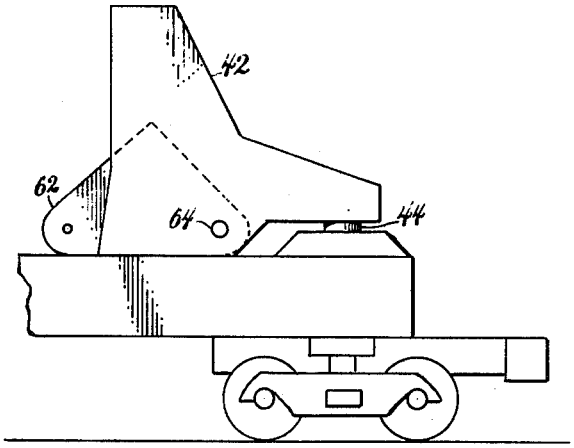
FIG. 4 is a side elevation showing an arrangement by which the device of FIG. 3 may be transported in an empty condition.

Each "mini-arm" 42 is provided with an independent section 62 that is removably attached thereto by pin 64 to provide convenience in handling when the Schnabel car is fully loaded and it is necessary to move the "mini-arm" by flatcar in the manner shown by FIG. 4. Thus, the section 62 may be moved out of the way and the entire "mini-arm" 42 readily supported upon the flatcar 46.

I claim:

1. An arrangement for pivotally linking together wheeled sections of a Schnabel-type car that have a lower tension arm and an upper compression pad, a connecting arm that extends vertically between the tension arm and the compression pad of each wheeled section, pivot means with a horizontal axis of rotation linking the tension arm to the connecting arm, means on said connecting arm adapted to abut the compression pad on said wheeled section, and pivot means with a vertical axis of rotation adapted to link adjacent connecting arms whereby spaced wheeled sections are simultaneously movable about a vertical and a horizontal axis.

2. An arrangement as defined in claim 1 wherein the pivot joint having a vertical axis of rotation joining spaced connecting arms is divided into axially spaced upper and lower sections.

3. An arrangement as defined in claim 2 including damping means arranged intermediate axially spaced pivot means to resist independent movement thereof.

4. An arrangement as defined in claim 1 including a separable wheeled vehicle intermediate wheeled sections of said Schnabel-type car adapted to support the pivot means with a vertical axis, said pivot means with a vertical axis of rotation being mounted on opposite ends of the separable wheeled vehicle to provide transportation for the pivot means when the Schnabel car is being utilized to haul an elongate load between wheeled sections thereof.

5. An arrangement as defined in claim 4 wherein the connecting arms comprise a plurality of independent parts, and means removably linking said parts together to permit the connecting arms to be separated into a plurality of parts to facilitate handling.

* * * * *